United States Patent [19]

Walter

[11] 3,993,988

[45] Nov. 23, 1976

[54] INTRUSION DETECTION APPARATUS TO SIGNAL MOVEMENT OF A PARTITION

[76] Inventor: John W. Walter, 20 Beechwood Ave., Port Washington, N.Y. 11050

[22] Filed: June 2, 1975

[21] Appl. No.: 583,154

[52] U.S. Cl. ..... 340/274 R; 200/61.62; 335/205

[51] Int. Cl.[2] ..... G08B 13/08

[58] Field of Search ..... 340/274 R; 335/205; 200/61.62

[56] References Cited

UNITED STATES PATENTS

| | | | |
|---|---|---|---|
| 3,087,145 | 4/1963 | Fruh | 340/274 |
| 3,175,207 | 3/1965 | Hewitt, Jr. | 340/274 R |
| 3,243,797 | 3/1966 | Smith | 340/274 R |
| 3,330,922 | 7/1967 | Rowe | 340/274 R |
| 3,626,340 | 12/1971 | Mason et al. | 335/205 |
| 3,696,380 | 10/1972 | Murphy | 335/205 |
| 3,887,909 | 6/1975 | Beiswenger et al. | 340/274 R |
| 3,899,784 | 8/1975 | McHenry | 340/274 R |

*Primary Examiner*—Glen R. Swann, III
*Attorney, Agent, or Firm*—Pennie & Edmonds

[57] ABSTRACT

An intrusion detecting apparatus for an alarm system to signal breakage and movement of a door, window, or other movable partition comprises an elongated member forming an interior channel in which is disposed a switch actuating element for motion into and out of cooperative relation with a switch element supported on the channel. The switch actuating element is connected to the partition by a tensile member and is coupled to the elongated member by a spring so that movement of the partition from a predetermined position causes the switch actuating element to move out of cooperative relationship with the switch element and movement of the partition back to the predetermined position restores the element to a cooperative relationship. The tensile member may include a pair of electrical conductors which are connected to a device for detecting breakage of the partition.

9 Claims, 10 Drawing Figures

FIG. 8
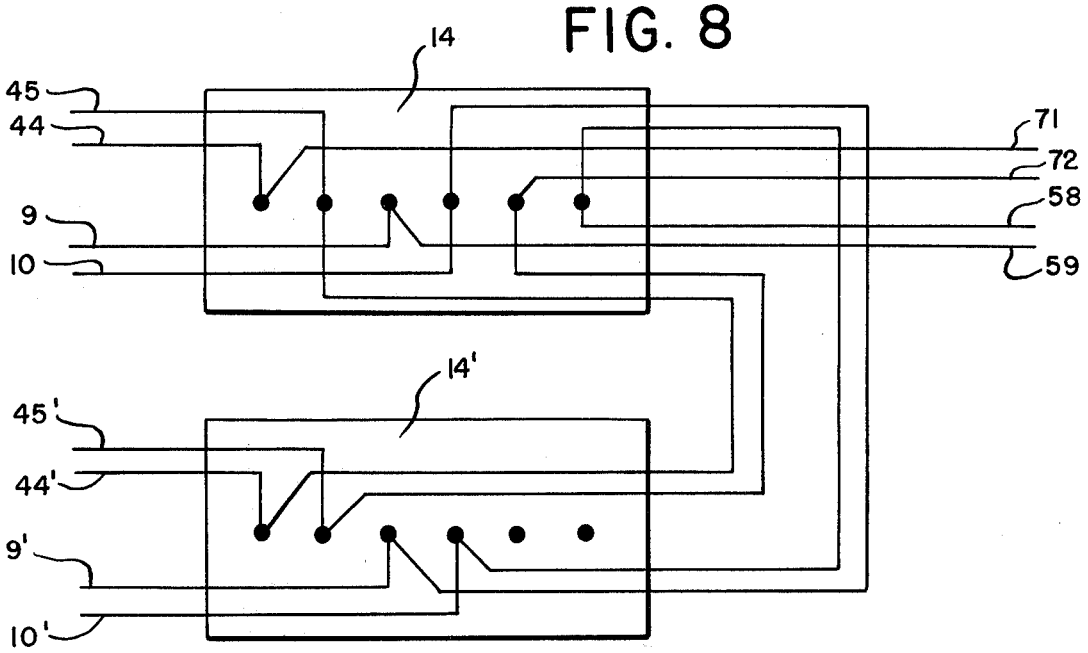
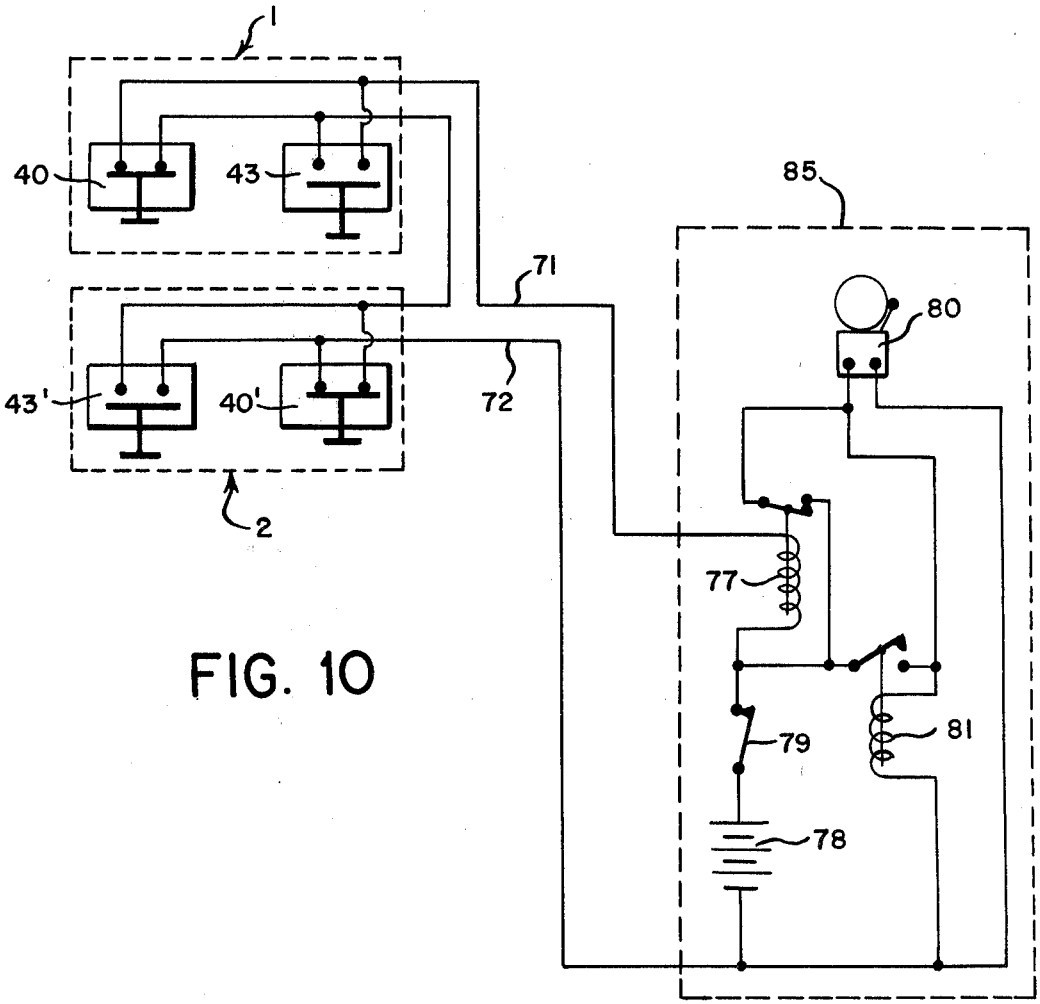
FIG. 10

INTRUSION DETECTION APPARATUS TO SIGNAL MOVEMENT OF A PARTITION

BACKGROUND OF THE INVENTION

The present invention relates to an apparatus for the detection and signalling of an unauthorized opening and/or fracture or other positional shift of a movable partition, such as a window or sliding door, which apparatus is substantially tamper-proof, easy to install and not susceptible to accidental damage.

Prior systems, heretofore used to detect the unauthorized opening of doors and windows, and known to me, have utilized mechanically or magnetically operated switches mounted on the door or on the window. In one such prior art structure, a magnetically operated reed switch whose contacts are spring-biased to open position is affixed to the window sash, i.e. to the movable part of the window to be guarded, and a magnet is mounted on the frame of the window opposite the switch. As the sash moves to open the window, the switch moves out of the field of influence of the magnet. The switch contacts thereupon open and this activates a burglar alarm or other signalling device arranged to be activated upon opening of the circuit in which the reed switch is included.

In a second prior art system, a mechanically operated switch having normally open pushbutton or cam-operated contacts is mounted on the window sash. The switch is operated by a wiper arm or cam affixed to the window frame such that, when the window is closed, the contacts are closed. As the window is opened, the switch moves out of engagement with the wiper arm, its contacts open, and cause the alarm to be activated.

It has also been proposed to reverse this arrangement of parts, by putting the switch on the window frame while putting the actuating element therefor, whether a magnet or a cam, or of other nature, on the sash in such position that this element holds the switch in the condition (e.g. a closed contact condition) for which the alarm is not activated, when the window is closed.

In all of these prior art constructions, either the switch or the actuating element is mounted on the sash and the other is mounted on the window frame immediately adjacent thereto, such that both the switch and the switch actuating element can be easily seen by a potential intruder looking in through the window. Once seen, the prior art devices can be fairly easily deactivated by reaching in through a hole cut in the window pane and attaching a magnet to the reed switch, by taping the pushbutton of a mechanical switch in the closed position, or by bypassing the switch by means of jump wires.

Furthermore, with the switch element (i.e. the switch proper) and the actuating element therefor, one on the frame and the other on the sash, there is a risk of false alarms due to lateral motion of the sash under the influence of the wind, for example, even when no effort is made to move the sash up or down.

These considerations also apply to alarm systems of the prior art types hereinabove described as mounted on or employed in conjunction with casement windows and other movable partitions.

Another defect of the prior art devices is that since the switches are mounted on the window sash or frame, they are exposed to the weather when the windows are open and are thereby subject to deterioration.

It has also been proposed in the prior art to apply to the glass pane of a door or a window a strip of conductive foil which is ruptured by the breakage of the glass thereby activating a burglar alarm connected to the strip. In order to permit movement of the window, the prior art systems utilized a flexible cord to connect the conductive strip on the pane with the burglar alarm circuit. This cord was unsightly or inconvenient if long enough to permit substantial motion of the pane, or else it required for the purpose manual plugging and unplugging of a connector to join the cord to the remainder of the circuit at the jamb.

BRIEF SUMMARY OF THE INVENTION

In accordance with the present invention, apparatus for the detection and signalling of positional shifts of a movable partition comprises a switching element, a switch actuating element, guide means for supporting one of those elements for motion into and out of cooperative relation with the other of those elements, and means coupling the one element to the partition.

The guide means may advantageously be in the form of a U-shaped channel, the bottom of which is adapted to slideably support one of those elements. The other element is mounted in fixed position on or adjacent the channel in a manner such that when the slideably disposed element moves to a position along the guide means opposite the other element, the two elements will be in cooperative relation with each other, and the switching element will be set to what may be called the no-alarm condition.

The apparatus is installed by affixing the guide means and the "other" element (i.e. the one not supported on the guide means) to the stationary frame in which, or to the wall adjacent one side of the partition with reference to which, the movable partition moves, and by coupling the guide means-supported element of the apparatus to the partition with coupling means which position that element in cooperative, no-alarm relation with the other fixed element, when the partition is itself in the no-alarm position — e.g. closed, in the case of a window or door. The coupling means may for example take the form of a cord connected between the guide means-supported element and the movable sash, in the case of a window, and a spring coupled between that guide means supported element and the guide itself so as to stress the guide means supported element to positions in which the cord is maintained taut.

When the apparatus of the present invention is used in conjunction with partitions having glass panes, the coupling means may advantageously comprise two or more electrical conductors. The coupling means can then be utilized not only to couple the guide means supported element mechanically to the partitions, but also to connect a conductive strip applied to the glass pane with a burglar alarm, which will be activated upon rupture of the strip due to the breakage of the glass even without motion of the sash.

BRIEF DESCRIPTION OF THE DRAWINGS

The invention will now be described in further detail and in terms of a number of presently preferred exemplary embodiments with reference to the accompanying drawings in which:

FIG. 8 is a diagram showing how the detectors of FIG. 1 may be wired together;

FIG. 10 is a diagram similar to that of FIG. 9 but showing a modified alarm system according to the invention.

DESCRIPTION OF PREFERRED EMBODIMENTS

Figure 1:
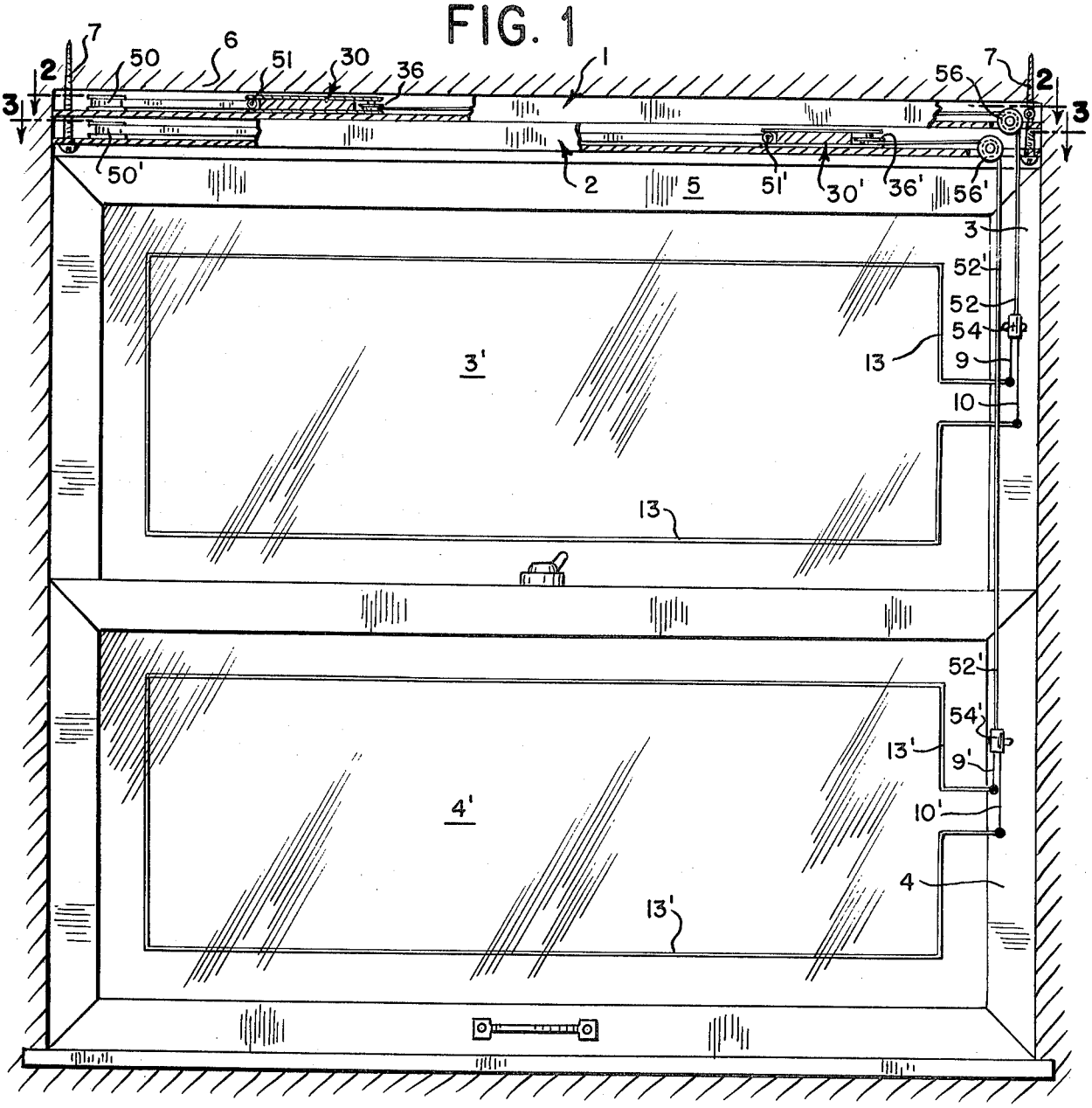
FIG. 1 is a view in elevation, showing two position shift detectors in accordance with the invention, shown partially broken away, each coupled to a separate one of the upper and lower sash of a double hung window for signalling motion of either sash out of the closed position therefor and further for signalling breakage of the glass in either sash.
Figure 2:
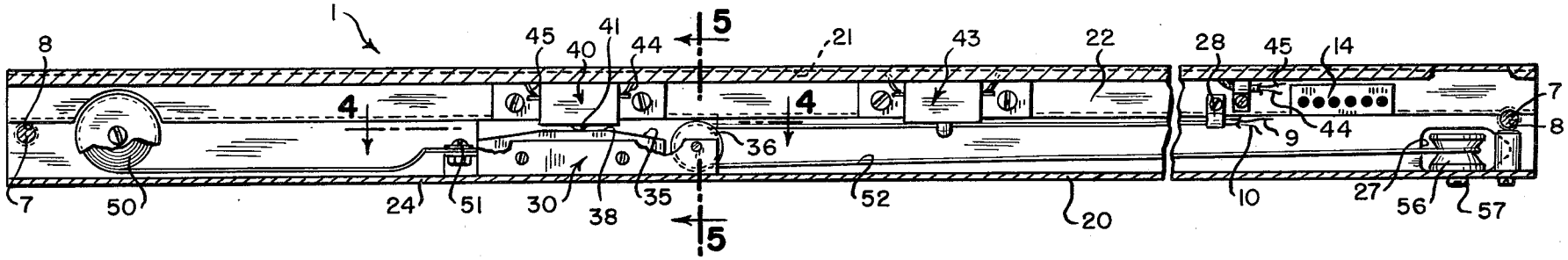
FIG. 2 is a plan sectional view of the detector for the upper sash in FIG. 1, taken on the line 2—2 of FIG. 1.
Figure 3:
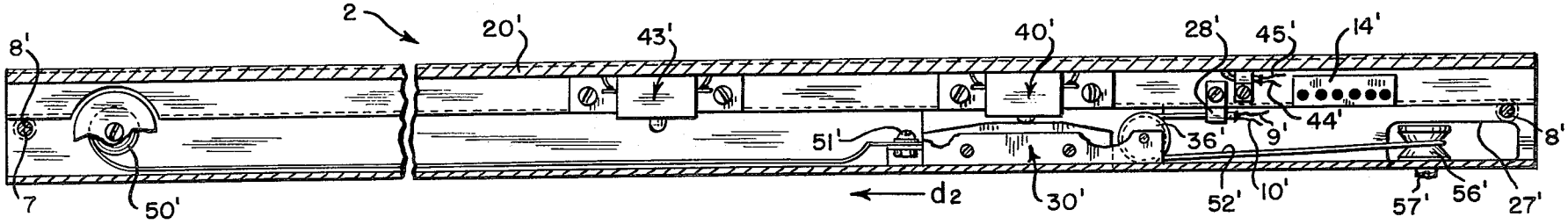
FIG. 3 is a plan sectional view of the detector coupled to the lower sash of FIG. 1 and taken on the line 3—3 off FIG. 1.

Referring now to the drawings, FIG. 1 shows two position shift detectors, indicated generally at 1 and 2, affixed to the frame or lintel above a double hung window generally indicated at 5. Detector 1, which is shown in greater detail in FIG. 2, is coupled to and detects positional shifts of the upper sash 3. Similarly, detector 2, shown in greater detail in FIG. 3, is coupled to and detects positional shifts of lower sash 4. The embodiment of the invention shown in FIG. 1 additionally incorporates means to detect and report breakage of the glass panes 3′ and 4′ of the upper and lower sash 3 and 4.

Figure 5:
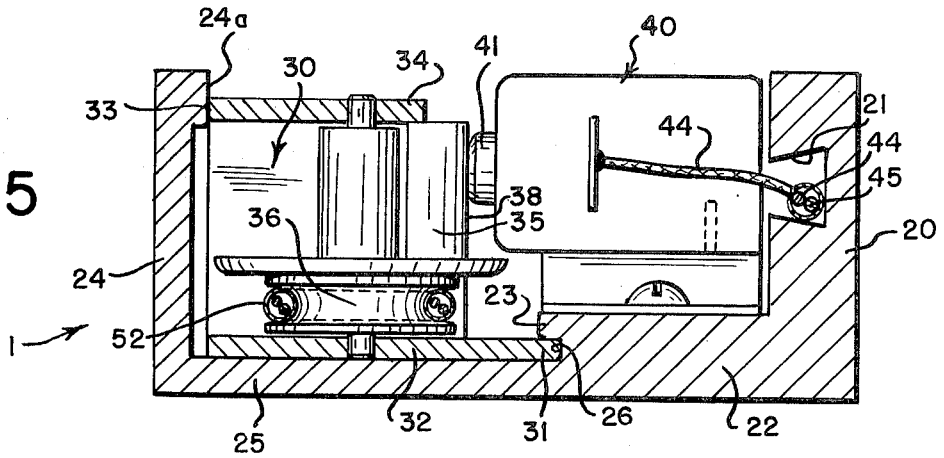
FIG. 5 is a fragmentary sectional view in elevation taken on the line 5—5 of FIG. 2 and shown at an enlarged scale.
Figure 4:
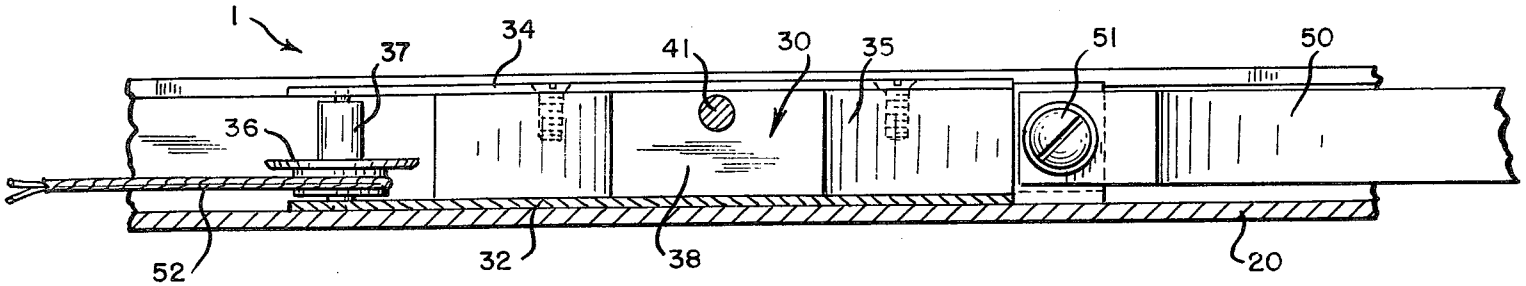
FIG. 4 is a fragmentary sectional view in elevation taken on the line 4—4 of FIG. 2; reversed right for left and shown at an enlarged scale.

Referring to FIGS. 2, 4 and 5, the intrusion detector 1 there shown includes a guide means constituted by channel member 20, the bottom of which has a step 22 formed along one side thereof. Step 22 extends along the length of channel member 20 and together with step riser 23, wall 24 and bottom portion 25 of the channel opposite the step, forms a trough in which switch actuating element 30 is slideably disposed.

Edge 31 of base 32 of the switch actuating element engages a groove 26 in riser 23 and edge 33 of upper plate 34 of the element contacts the interior upper surface 24*a* of wall 24 of channel 20, thereby preventing vertical and transverse movement of the switch actuating element 30 as it slides along the bottom of the trough longitudinally of the channel.

The switching element 40, which may be a normally open, push-button operated switch as shown in FIGS. 2 and 5, is mounted on the upper surface of step 22 with its operating button 41 overhanging the bottom of the trough. Switch actuating element 30 is formed with a cam surface 35 that is adapted to contact and depress button 41, thereby closing switch 40, when switch actuating element 30 is at a position in the trough opposite switch 40. Switch 40 is connected electrically to the alarm circuit in the manner hereinafter described by leads 44 and 45 which feed through groove 21 in the wall of channel 20.

As seen in FIG. 2, one end of switch actuating element 30 is fastened by a screw 51 to the end of a resilient means constituted by coiled spring 50 which in turn is affixed to one end of channel 20. The opposite end of switch actuating element 30 is coupled by a tensile means constituted by cord 52 to the upper sash 3 of the window 5. As shown in FIG. 1, cord 52 is secured to window sash 3 by clamp 54, extends along the frame of the sash and feeds through an opening 27 (FIG. 2) in the bottom of channel 20.

After entering through opening 27, cord 52 passes over a first pulley 56 mounted rotatably to the wall of channel 20 above opening 27, passes around a second pulley 36, which is rotatably mounted on movable switch actuating element 30, and then is secured to the bottom of the channel by clamp 28 close to the pulley 56.

The coil spring 50 thus keeps the cord 52 taut, and the switch actuating element 30 will move with the upper sash 3, but only at half of its speed and over half of its travel, taking up a separate position for each position of the sash.

Referring now to FIG. 3, the elements making up detector 2 are essentially the same as the elements of detector 1 hereinabove described. Elements of structure in FIG. 3 corresponding to those of FIG. 2 are identified by the same reference characters as in FIG. 2, distinguished however by the application of primes thereto. Moreover, the elements of detector 2 are arranged in essentially the same manner as the elements of detector 1 except that switch 40′ of detector 2 is mounted near the end of channel 20′ having opening 27′ disposed therein as hereinafter more fully described.

Thus switch actuating element 30′ is slideably disposed in channel 20′ in the same manner as the corresponding elements of detector 1 and is coupled to the lower sash 4 and to spring 50′ in the same manner as switch actuating element 30 of detector 1 heretofore described.

Referring now back to FIG. 1, the detectors 1 and 2, one stacked on top of the other, are installed first by securing them to lintel 6 by means of screws 7 which pass through holes 8 in the bottoms of the channels of the two devices. The clamps 54 and 54′ are then fastened to the upper and lower sash 3 and 4, the sash being in closed or other selected "no-alarm" position and the clamps being fastened to the sash in position to set the switch actuating elements 30 and 30′ opposite the switches 40 and 40′ so as to close their contacts. Thus, for detector 1, the installer pulls down on the cord 52 until switch actuating element 30 is opposite to switch 40 as shown in FIG. 2. Clamp 54 is then secured to sash 3.

In each detector, the installed can recognize engagement of the switch and switch actuating element by monitoring a resistance measuring instrument connected to the leads from the switch for an indication of the closing of the switch contacts, or by listening for an audible click made by the switch button when it is depressed by the switch actuating element. Moreover, as shown in FIGS. 2 and 3, cam surface 35 of the switch actuating element is provided with a flat area 38 so that the switch will be actuated to the no-alarm condition as long as button 41 is in contact with any portion of the flat area. Hence, flat area 38 provides the installer with some tolerance in determining the point at which the cord is to be secured to the window sash.

Thus, with the two detection devices installed in the above manner and the two halves of the window closed, the switch actuating element 30 of detector 1 engages switch 40 and switch actuating element 30' of detector 2 engages switch 40', as shown in FIGS. 2 and 3, respectively. However, if the upper sash is lowered, its downward movement will draw the cord 52 downward and cause element 30 to move to the right, as seen in FIG. 2. As the flat area 38 of cam surface 35 moves away from the spring-loaded contact-controlling button 41, the button will spring outwardly, permitting switch 40 to shift the state of its contacts, from closed to open condition, thereby setting off a burglar alarm in the manner hereinafter to be described.

Similarly, if the lower sash 4 is raised, spring 50' in detector 2 will draw the actuating element 30' to the left, as seen in FIG. 3, as permitted by the rising cord 52'. Element 30' will thus be withdrawn from engagement with switch 40', and the burglar alarm will likewise be set off.

Because opening of the upper sash causes switch actuating element 30 to shift to the right, as shown in FIG. 2, switch 40 is mounted near the left end of the channel member 20 at a location such that when the window is fully opened (or, more accurately, pulled down as far as it will go), switch actuating element 30 will stop before reaching opening 27. On the other hand, since the raising of the lower sash causes switch actuating element 30' to move to the left in FIG. 3, switch 40' is mounted near the right end of the channel 20' at a position such that the element 30' will come to a stop before reaching the coil of spring 50' when the lower sash is fully raised.

The detectors 1 and 2 may advantageously include each a second switch 43 in FIG. 2 and 43' in FIG. 3, whose contacts are in parallel with those of the switches 40 and 40' already described, but displaced in the channels 20 and 20' of those detectors so as to provide for each of the upper and lower sash of the window a second no-alarm position. This makes it possible for the householder to set either sash to a selected open position, identified for example by a marking or detent mechanism on the window frame, in which the associated burglar alarm will not be set off. Upon shift of the sash from this second no-alarm position, the alarm will however be set off unless disabled by a switch, which may be provided for that purpose inside the premises. In FIG. 2 the auxiliary alarm switch 43 is thus displaced to the right of the closed position alarm switch 40 by one-half the distance through which the upper sash must be lowered to go from the fully closed no-alarm position to the second no-alarm position just described.

In similar fashion, the auxiliary alarm switch 43' is disposed in the channel 20' of the detector 2 of FIG. 3 to the left of the first alarm switch 40' by one-half the distance through which the lower sash must be raised to move from the fully closed no-alarm position for the lower sash to the selected open no-alarm position therefor.

The switches 40 and 43 each serve, when closed, to short-circuit together two leads 44 and 45 seen in FIG. 2. These leads may be included in a circuit responsive to departure of those leads from the short-circuit condition to sound an alarm or otherwise make a signal.

The switches 40 and 43 of FIG. 2 and 40' and 43' of FIG. 3 have been described as being of normally open type. They are single-pole, single throw switches, spring loaded to the open position of their contacts. They are shifted to close their contacts when they are engaged by the associated switch actuating elements 30 of FIG. 2 and 30' of FIG. 3 respectively, i.e. when the associated sash is in one of its no-alarm positions. Thus, for example, when either of switches 40 and 43 is actuated by actuating element 30, its contacts are closed and the two leads 44 and 45 of FIG. 2 are short-circuited together.

The cords 52 and 52' include each a pair of conductors, identified at 9 and 10 for cord 52 and at 9' and 10' for cord 52'. The conductors 9 and 10 connect, below the clamp 54 in FIG. 1, to the ends of a conductive strip 13 applied to the pane 3' of the upper sash, and the conductors 9' and 10' similarly connect to the ends of a similar conductive strip 13' applied to the pane 4' of the lower sash. Upon breakage of either pane in a region thereof traversed by the strip, the electrical continuity of the strip is broken, and this change in electrical configuration is employed to activate the associated burglar alarm even without motion of either sash.

For connection of the detectors 1 and 2 into a burglar alarm circuit, either single or together, they may conveniently be provided with terminal boards 14 and 14' respectively, as seen in FIGS. 2 and 3.

Advantageously the leads 44, 45, 44' and 45' to the switches 40, 43, 40' and 43' of the detectors 1 and 2 are connected in series, and the leads 9, 10, 9' and 10' to the strips 13 and 13' are likewise connected in series. The two series circuits so obtained may then be connected into a single series circuit connected across the input to an alarm circuit which will detect and signal any departure from a short-circuit condition across that input, whether by opening of one of the switches 40, 43, 40' and 43' upon motion of the upper and lower sash or by breakage of one of the strips 13 and 13'.

In order however to permit the householder, at his discretion, to remove from the effective input to the alarm circuit the position sensors of FIGS. 1 and 2 (so as to permt him to leave his windows open at will), the burglar alarm may include a manually operated switch by means of which the series connection of leads 44, 45, 44' and 45' may be short-circuited independently of the condition of the switches 40, 43, 40' and 43'. The series circuits, one including leads 44, 45, 44' and 45' and the other including leads 9, 10, 9' and 10' are therefore preserved separate as far as this switch. In order to combine the two intrusion detectors of FIGS. 2 and 3 with the conducting strips 13 and 13' of FIG. 1 in this way, the two detectors 1 and 2 may be wired together at their terminal boards 14 and 14' in the manner indicated in FIG. 8.

In FIG. 8, leads 71 and 72 at the right are leads to the series circuit including leads 44, 45, 44' and 45' of the position sensor elements of the apparatus of FIG. 1, and leads 58 and 59 are leads to the series connected leads 9, 10, 9' and 10' of the conducting strips 13 and 13' of FIG. 1.

Figure 9:
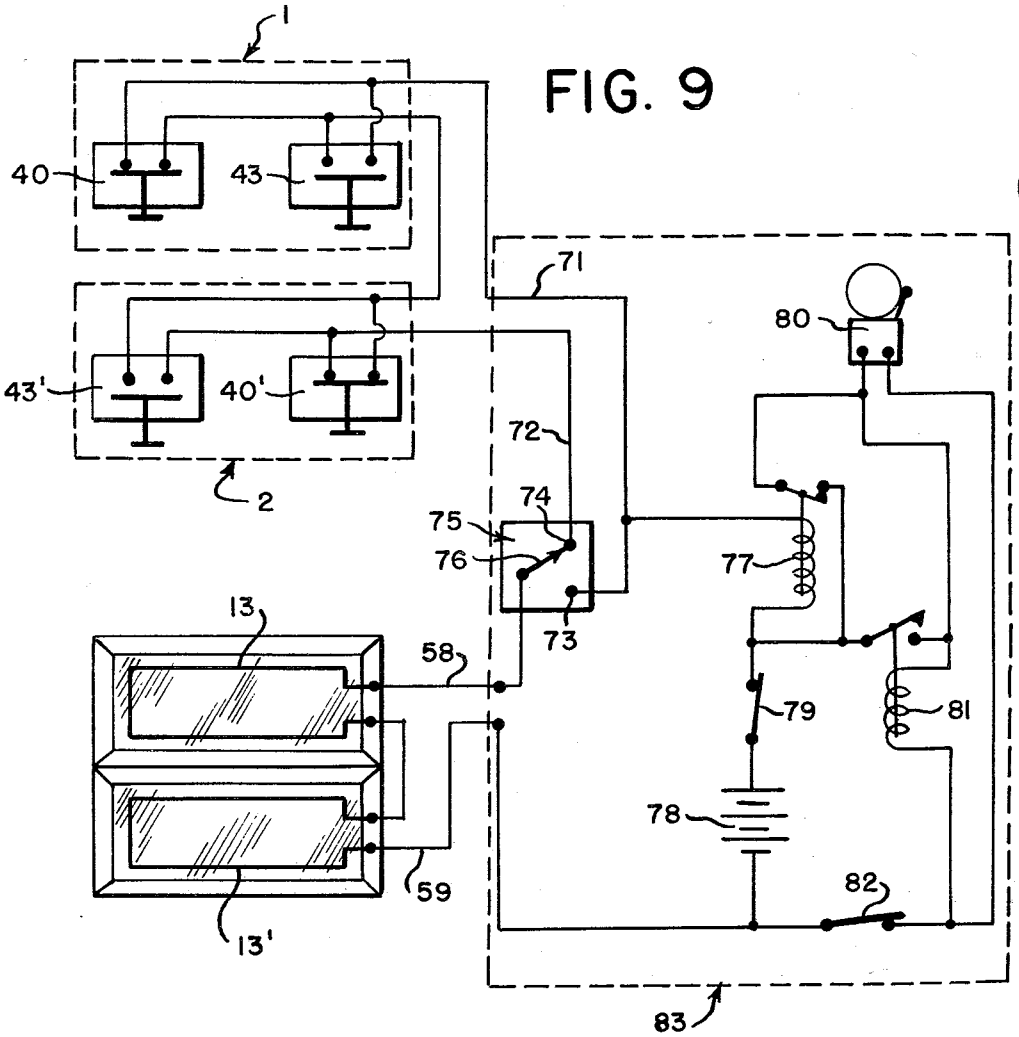
FIG. 9 is a schematic diagram of a burglar alarm system incorporating the position shift and glass breakage detectors of FIG. 1.

Referring now to the alarm circuit shown in FIG. 9, dash-line box 1 represents detector 1 of FIG. 2 which is coupled to and signals the positional shift of upper sash 3. With the upper sash in the closed position, switch 40 is closed by the switch actuating element 30, as heretofore described, and its contacts are closed as shown in FIG. 9. The auxiliary switch 43 is connected in parallel with switch 40, and with the upper sash closed its contacts are in their normally open position.

Dash-line box 2 represents detector 2 of FIG. 3 which is coupled to and signals positional shifts to lower sash 4. The auxiliary switch 43' is connected in parallel with switch 40′ and the auxiliary switch 43′ and switch 40′ are shown in the open and closed positions respectively which they occupy when the lower sash is in the closed position.

Dash-line box 83 represents the burglar alarm unit which can be installed at some convenient location inside the premises.

The burglar alarm circuit includes a battery 78, a single pole, single throw main on-off switch 79, an electrically operated alarm bell 80, relays 77 and 81, and a "day-night" switch 75. Relay 77 has a single pair of contacts, spring loaded to closed position. Relay 81 is a time-delay relay, whose single pair of contacts is spring loaded to open position and which closes only upon elapse of a suitably chosen short time after voltage is applied to the coil of that relay.

Switch 75 is a single pole double throw switch. Leads 71 and 72 of FIG. 8 are connected to the two poles 73 and 74 of switch 75. One of leads 58 and 59 of FIG. 8 is connected to the blade 76 of switch 75 and the other of those leads is connected to the side of the battery 78 remote from the coil of relay 77.

With switch 75 in the position wherein its blade contacts the pole 74, a series circuit, including leads 71, 72, 58 and 59, and hence including the position shift sensor switches 40, 43, 40′ and 43′ and the strips 13 and 13′, is connected across the series combination of battery 78, switch 79 and the coil of relay 77. Provided one of the switches in each of the detectors 1 and 2 is closed, and further provided that the strips 13 and 13′ are unbroken, electrical continuity will exist outside the dashline box 83 from the switch pole 73 to the side of the battery 78 remote from the coil of relay 77. If then the switch 79 is closed to place the alarm circuit in operation, relay 77 will be energized and will open its contacts, preventing the application of voltage to the terminals of the electrical alarm 80. The time delay characteristic of relay 81 does not permit its contacts to close from application of voltage to the coil of that relay over the short time required for the contacts of relay 77 to open.

If however either the upper or lower sash is moved out of its no-alarm position, so that in detector 1 both of the switches 40 and 43 are open, or so that in detector 2 both of the switches 40′ and 43′ are open, or if either of the conductive strips 13 and 13′ is broken, voltage will be removed from the coil of relay 77. Its contact will therefore close and the alarm 80 will be energized. Moreover, relay 81 will also be energized, to close its contacts and thereby provide an alternative path for energizing the alarm 80. Hence the alarm will continue to sound or otherwise operate, notwithstanding re-energization of relay 77, as would occur if the upper or lower sash, having been moved to interrupt the circuit, were restored to closed position.

If switch 75 is thrown to its other position (a "day" setting), to connect its blade 76 to its pole 73, the switches 40, 43, 40′ and 43′ are effectively disabled and taken out of circuit, and the two halves of the window may be moved at will without resulting in operation of the alarm 80.

The detectors 1 and 2 of FIGS. 1 to 3 are of course usable either singly or together, and they may be used without the conductive strips 13 and 13′ of FIG. 1. Either or both of detectors 1 and 2 may thus include cords 52 and 52′ having no conductors therein. Such an embodiment of the invention is illustrated in FIG. 10. FIG. 10 shows schematically the detector units 1 and 2 connected in series to leads 71 and 72 as in FIGS. 8 and 9. These connect to an alarm circuit indicated by a dash-line box 85. This alarm circuit may be similar to the alarm circuit 83 of FIG. 9, except that the switch 75 of FIG. 9 is omitted therefrom and except that the lead 72 is connected directly to the side of battery 78 remote from the coil of relay 77.

Figure 6:
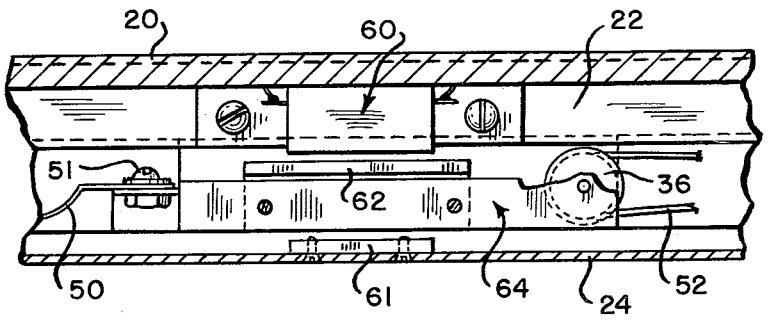
FIGS. 6 and 7 are fragmentary plan sectional views of other forms of position shift detectors or signalling devices according to the invention.
Figure 7:
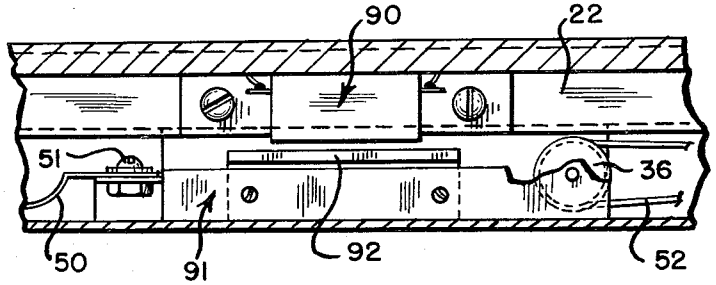

Alternative embodiments of the position shift detector of the invention are illustrated in FIGS. 6 and 7.

In the embodiment of the invention shown in FIG. 6, the mechanically operated switching element 40 of FIG. 2 is replaced by a magnetically operated reed switch 60. The switch 60 is also of single pole, single throw type, and its contacts are shaped so that a spring stress therein holds them closed except when a magnetic field operates on an armature fastened to one switch contact so as to open those contacts. Reed switch 60 is mounted in the channel member 20 in the same manner as is the switching element 40 of FIG. 2. A permanent magnet 61 is affixed to the interior surface of the channel 20 opposite the reed switch 60, as shown in FIG. 6. A switch actuating element 64, similar to the element 30 of FIG. 2, is slidably disposed in a trough formed in the bottom of channel 20. In place however of the cam 35 of FIG. 2, the element 64 includes a plate 62 made of ferromagnetic material which is interposed between the magnet 61 and the reed switch 60 when the switch actuating element 64 moves into a position in the channel opposite the reed switch. The plate 62 then shields the switch 60 from the field of the magnet 61 and the contacts of the switch 60 will be in their normally closed position. If however the partition to which the actuating element 64 is coupled is moved out of the no-alarm position illustrated in FIG. 6, the plate 62 will be withdrawn from between the switch 60 and the magnet 61. The magnet 61 will then open the contacts of the switch 60 and the associated alarm will be energized.

In the embodiment of the invention shown in FIG. 7, there is employed a switching element 90 similar to the element 60 of FIG. 6 except that, in contrast to the switch of FIG. 6, the switch 90 of FIG. 7 is a reed switch whose contacts are normally open. That is, they are spring-biased to open position until and unless a magnetic field, operative on an armature attached to or forming part of one of the switch contacts, moves the contacts to closed position. The switch actuating element 91 of FIG. 7 is again similar to the switch actuating element of FIG. 2. In place however of the cam 35 of FIG. 2, the element 91 of FIG. 7 includes a magnet 92 which serves to close the contacts of the switching element 90 when the actuating element 91 is opposite the switching element 90, as illustrated in FIG. 7.

Although in the embodiments of the invention hereinabove described, the switching element is shown as fixed in position while the switch actuating element is movable with respect thereto, and is coupled to move with the window or other partition being monitored, this arrangement may be reversed. Thus, the switching element may be coupled to the partition to move therewith while the switch actuating element is stationary, although this arrangement entails the use of flexible leads to connect the movable switching element electrically to the remainder of the circuit.

In the embodiments described, the switching element has possessed contacts which are closed when the partition, and hence when the switch actuating element coupled thereto, are in the no-alarm position. Operative alarm systems may however be built according to the present invention in which the switching contacts are open for the no-alarm condition of the partition being monitored, a shift of the partition serving to close those contacts and thereby to trigger an associated alarm.

Moreover, the position shift sensor of the present invention may be used in conjunction with movable portions of type other than the double hung window shown in FIG. 1. For example, the apparatus shown in FIG. 2 may be used to signal a positional shift of a casement window. If the sash is vertically hinged, the channel 20 may be secured in a vertical position to the stationary vertical portion of the frame of the window adjacent the vertically hinged window sash. The opening 27 of FIG. 2 may be placed in the side rather than the bottom of channel 20, so that the cord coupling the switch actuating element to the sash feeds through the opening in the side of the vertically mounted channel and is secured to the edge of the sash opposite the hinged side thereof. The apparatus may also be used in conjunction with sliding doors by affixing the channel 20 to the horizontal portion of the stationary door frame and by coupling the switch actuating element thereof to the upper portion of the door.

The invention thus provides an apparatus for signalling the positional shift of a movable partition. In the exemplary embodiments of FIG. 2, this apparatus comprises a switching element 40, a switch actuating element 30, a guide means 20, supporting one of the elements for motion in and out of cooperative relation with the other of those elements, and means 52 coupling said one element to said partition.

While the invention has been described hereinabove in terms of a number of presently preferred embodiments, the invention itself is not limited thereto, but rather comprehends all modifications of and departures from those embodiments properly falling within the spirit and scope of the appended claims.

Without limitation on the generality of the foregoing, the position shift detectors of the invention may be electrically connected to an alarm circuit not on the premises wherein are located the partition or partitions being monitored by those sensors, but rather at a remote location. If in such a case a switch 75 is provided, as in FIG. 9, it will be provided in those premises, and other switching means may moreover be there provided to disable the alarm function at the election of the householder.

Further, the invention is also applicable to alarm systems which detect loss of integrity of the partition, as for example by breakage of a glass pane, even without rupture of a conducting path thereover and without bodily motion of the partition, with the aid of a vibration- or acceleration-responsive device in place of or in addition to the foil strips 13 and 13' shown in the embodiments illustrated. Thus for example the strips 13 and 13' may be replaced and/or supplemented with a normally closed switch forming part of an acceleration or vibration-responsive device attached to the pane. Breakage of the pane even without rupture of the strip 13, if present, will open such a normally closed switch. The switch may be included via additional conductors in the cords 52 and 52' in circuit with the alarm device. Further conductors may be included in the cords 52 and 52' for the supply of electric energy to an amplifying circuit in order to translate the motion of a low inertia acceleration-responsive element into the opening of such a switch.

I claim:

1. Intrusion detecting apparatus for an alarm system to signal a movement of a door, window, or other movable partition in a wall of an area secured against the unauthorized intrusion, said apparatus comprising:

an elongated member forming an interior channel, said elongated member being mountable on a wall adjacent one side of such partition;

electrical switching means including an element supported on said channel and a cooperating element disposed in said channel for translational motion longitudinally of said channel into and out of cooperative relation with said first-named element to change the state of the switching means between an alarm and a no-alarm condition;

a tensile member for connecting said cooperating element to such partition and resilient means engaged between said cooperating element and said elongated member, said tensile member and said resilient means being arranged so that movement of the partition from a predetermined position moves the cooperating element with respect to said first-named element changing the state of the switching means from a no-alarm to an alarm condition, and movement of the partition substantially back to said predetermined position restores said cooperating element to said cooperative relationship with said first-named element corresponding to the no-alarm condition of said switching means.

2. Apparatus according to claim 1 wherein said first-named element is a mechanically operated switch and wherein said cooperating element has a surface adpated for actuating said switch when the switch and cooperating element are in cooperative relation with each other.

3. Apparatus according to claim 1 wherein the first-named element is a magnetically operated switch and wherein the cooperating element includes a magnet which actuates said switch when the switch and cooperating element are in cooperative relation with each other.

4. Apparatus according to claim 1 wherein the first-named element comprises a magnetically operated switch and a magnet disposed opposite said switch and wherein the cooperating element includes a ferromagnetic body which is interposed between said switch and said magnet when the first-named element and cooperating element are in cooperative relation with each other.

5. Apparatus according to claim 1 wherein said tensile member comprises a pair of electrical conductors, said apparatus further comprising an electrically conductive strip disposed on the partition, one end of said strip being electrically connected to one of the conductors of said pair and the other end of said strip being connected to the other of the conductors of said pair.

6. Apparatus according to claim 5 further including a signalling device in circuit with said switching means and with said electrically conductive strip.

7. Apparatus according to claim 1 further including a signalling device in circuit with said switching means.

8. An apparatus according to claim 1 wherein said tensile means includes a plurality of electrical conductors, said apparatus further comprising means connected with said conductors for signaling breakage of such partition.

9. Apparatus to signal a positional shift of a movable partition, said apparatus comprising a switch element, a switch actuating element, guide means supporting one of said elements for motion into and out of cooperative relation with the other of said elements, resilient means engaged between said one of said elements and said guide means, a plurality of electrical conductors coupling said one element with such partition, and means for signaling breakage of such partition connected with said conductors.

* * * * *